United States Patent [19]

Snyder et al.

[11] 4,119,277

[45] Oct. 10, 1978

[54] APPARATUS FOR CUTTING SCRAP TIRES

[76] Inventors: J. Rush Snyder, 3013 Harcourt Dr., Greensburg, Pa. 15601; Timothy Myers, R.D. #2, Box 238A, Latrobe, Pa. 15650

[21] Appl. No.: 626,321

[22] Filed: Oct. 28, 1975

[51] Int. Cl.[2] ..... B02C 13/02; B02C 18/22

[52] U.S. Cl. ..... 241/167; 241/186 R; 241/190; 241/DIG. 31

[58] Field of Search ..... 241/186 R, 190, 191, 241/222, 223, 280, 243, 167, 242, DIG. 31

[56] References Cited

U.S. PATENT DOCUMENTS

| | | | |
|---|---|---|---|
| 2,440,051 | 4/1948 | Lind et al. | 241/191 |
| 2,853,247 | 9/1958 | Anderson | 241/190 |
| 3,170,642 | 2/1965 | Haidler | 241/186 R |
| 3,202,369 | 8/1965 | Judd | 241/190 |
| 3,486,704 | 12/1969 | Persky | 241/190 X |
| 3,656,697 | 4/1972 | Nelson | 241/222 |
| 3,708,127 | 1/1973 | Brewer | 241/191 |
| 3,721,392 | 3/1973 | Burwell | 241/280 |
| 3,825,192 | 7/1974 | Knight | 241/186 R |

*Primary Examiner*—Granville Y. Custer, Jr.
*Attorney, Agent, or Firm*—Jon M. Lewis

[57] ABSTRACT

An improved apparatus for cutting scrap tires is disclosed wherein compressed scrap tires are cut. A scrap tire is compressed, then fed into a plurality of rotary disc cutters axially spaced along a shaft and rotated against a stationary anvil. In the preferred embodiment, cutting tools are vertically mounted on the rotary disc cutters, whose outer circumference is recessed in a concave arc starting at the top of the cutting tool and ending at that portion of the cutting tool closest to the center. The cutting tools are off-set along successive rotary disc cutters rather than placed in a line parallel to the shaft. Anvil tools having at least one cutting edge are mounted on the stationary anvil for ease in maintaining cutting edges opposite the rotating cutting tools. Cleaner bars facilitate the removal of cut scrap tires from the rotary disc cutters and their subsequent collection.

7 Claims, 5 Drawing Figures

APPARATUS FOR CUTTING SCRAP TIRES

This application is a continuation-in-part of our pending U.S. application, Ser. No. 587,593, now abandoned.

BACKGROUND OF INVENTION

1. Field of Invention

This invention discloses a novel apparatus for cutting scrap tires. More particularly, this invention discloses the apparatus for compressing the tires prior to their being cut.

Presently, scrap tires are not very desirable. They present problems of disposal and are not commercially useful on a large scale. They do not readily decompose, present a great volume for the amount of material contained and are generally undesirable.

2. Description of Prior Art

Prior art discloses numerous inventions for disposal of scrap tires. U.S. Pat. No. 3,721,392, Burwell discloses a device for compressing tires prior to their being ground down by a grinding belt. Although Burwell reduces the volume of tires, it does not claim the more advantageous cutting process. The grinding would create a fair amount of dust and present possible fire or pollution problems. Tires with carbide studs or steel belts could not be ground down without undue wear or the danger of sparks igniting the dust. Cutting the tires would present a faster, safer and more economical process.

A multitude of inventions are disclosed for cutting items other than tires. For example, U.S. Pat. No. 2,822,844, Bush discloses a compression of tobacco prior to its being cut. Our invention is distinguishable over Bush in that tobacco and tires are materials that have completely different properties. Scrap tires are more difficult to cut than tobacco because they are made of a harder, stickier, more flexible and abrasive material. Further, problems associated with steel belts, fiberglass and carbide pieces are not present in tobacco. The Bush machine, although adequate for cutting tobacco, would not be adequate to cut scrap tires.

Among the cutting machines disclosed for destruction of scrap tires are U.S. Pat. No. 3,727,858 and No. 3,817,463, Krigbaum. The Krigbaum patents disclose apparatus and devices for shredding whole tires without compression. Krigbaum teaches the use of two sets of cutting type assemblies for shredding scrap tires. The Krigbaum patents disclose devices that are relatively larger and less economical than the present invention because of the necessity for cutting whole tires through the use of two cutting assemblies and their related parts.

Since the compressed scrap tire requires a relatively smaller cutting area than a whole tire, the present invention may be relatively smaller than those known in the prior art. The use of a plurality of rotary disc cutters axially spaced along a shaft and rotating against a stationary anvil provides a simpler, more economical, consistent and smoother means for destruction of scrap tires then was heretofore known in the art.

SUMMARY OF INVENTION

This invention discloses an apparatus for cutting scrap tires. Scrap tires are compressed prior to their being cut.

In the preferred embodiment, tires are compressed after being fed into compression means comprising compression belts and compression rollers. The compressed scrap tire is then fed into a plurality of rotary disc cutters axially mounted on a rotatable shaft. The rotary disc cutters rotate against a stationary anvil having at least one cutting edge placed opposite the rotary disc cutters. The rotary disc cutters are dimensioned with a cutting tool mount situated on the outer circumference and directed toward the center. The outer edge of the rotary disc cutters is recessed in a concave arc starting at that portion of the cutting tool mount which is furthest away from the center of the rotary disc cutter and descending toward that portion of the cutting tool mount closest to the center.

By the use of cutting tools attached to cutting tool mounts and an anvil tool placed on the stationary anvil, this invention provides for easily maintainable and replaceable cutting edges. For more efficient operation, the cutting tools are off-set along successive rotary disc cutters.

The compressed scrap tire is cut as it tends to return to its former uncompressed shape and the cutting tools rotate against the anvil tool. The remaining compressed scrap tire is continuously fed into the rotary disc cutters by the action of the compression means feeding the tire into the rotary disc cutter, the natural tendency of the tire to return to its former shape when compressed and the rotary disc cutters pulling the compressed scrap tire as it rotates after the cut.

The compression means keeps the tire under control while it is being cut. The compression means grasps that portion of the scrap tire that is not yet cut and prevents overfeeding the machine.

A rotary disc support is placed between successive rotary disc cutters for strength and to minimize the volume of area available for accumulation of pieces of cut scrap tire. A cleaner bar prevents the accumulation of pieces of cut scrap tire next to the rotary disc cutters. Pieces of cut scrap tire fall either directly into a discharge chute by force of gravity, due to the rotation of the shaft, or after their removal between successive rotary disc cutters by the cleaner bar.

Our invention provides for the reduction of volume of scrap tires by cutting them into pieces that are a useable size for fuel additions, recycling purposes, disposal in land-fills, incineration and transportation. All types of scrap tires are cut without difference in tire type or mix between radial, fiberglass belted bias ply, steel belted bias ply, bias ply or carbide studded tire. The apparatus provides a relatively efficient operation with minimal maintenance requirements.

DESCRIPTION OF THE PREFERRED EMBODIMENT

Figure 1:
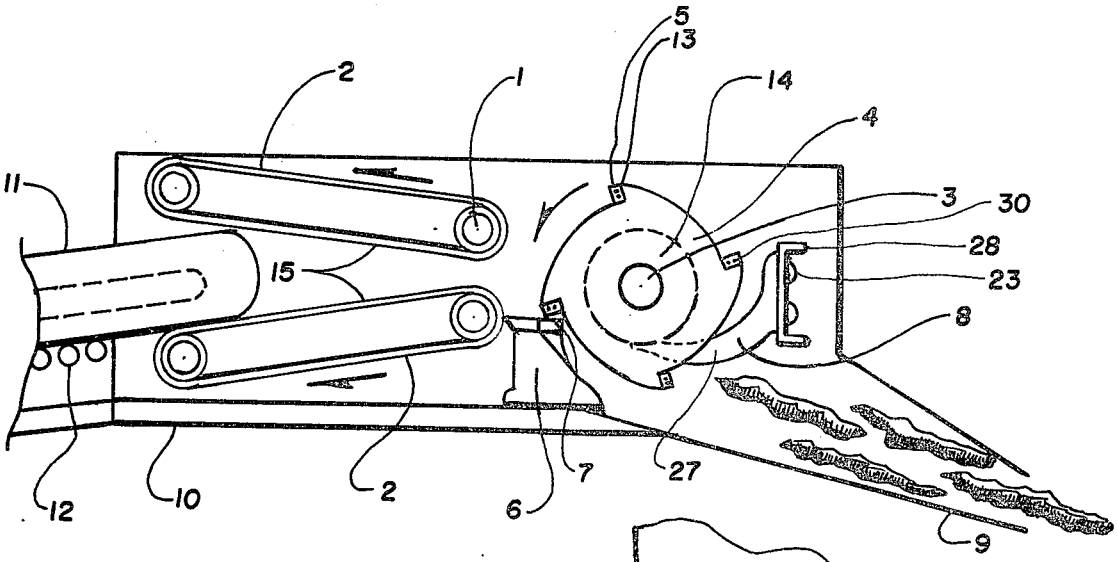
FIG. 1 is a partially cut away horizontal view of one embodiment of the present invention.

Referring to the drawings, numeral 10 refers to the housing on which the apparatus is mounted. Scrap tire 11 is fed into the apparatus by the use of any conventional transportation mechanisms, such as conveyor 12.

Compression means 15 attached to housing 10 compresses the scrap tire 11. In the preferred usage, compression means 15 comprises compression rollers 1 and compression belts 2. Any conventional power source can be used to actuate and run the compression rollers 1 and belts 2.

In the preferred embodiment, compression belts 2 surrounding compression rollers 1 compress scrap tire 11. As the compressed scrap tire is fed into the compression belts 2, it is compressed. In the preferred usage, passenger tires are compressed to approximately 2 inches in height. Of course, it should be considered by anyone skilled in the art that other ultimate heights of compression would still be within the purview of this invention. It would also be obvious to anyone skilled in the art that other means of compressing scrap tires, such as a beltless multi-roller device, would be adequate and with the purview of this invention.

Shaft 3 is mounted on the housing 10 and connected to any conventional power source for rotation purposes. A plurality of rotary disc cutters 4 are axially spaced along shaft 3. The rotary disc cutters 4 are dimensioned with at least one cutting tool mount 13 placed on the outer circumference of each cutter and directed vertically towards the center.

At least one cutting tool 5 of a generally rectangular design is fit upon each cutting tool mount 13. The cutting tools 5 may be manufactured from tool steel, carbide or other alloy with preferably more than one cutting edge so that the tool may be turned over for additional wear. Thus, each side of the rectangular cutting tools 5 may be used for cutting.

By off-setting each of the cutting tools 5 situated on cutting tool mount 13, along successive rotary disc cutters 4 operating efficiency is enhanced. The staggered placement of the cutting tools 5 permits the use of a relatively low powered and less expensive power source to cut a tire. Having the cutting tools off-set along the successive rotary disc cutters in a line not parallel with the shaft permits a tire to be cut with relatively less power.

The rotary disc cutters 4 are generally of circular shape. The outer edge is recessed in a concave arc starting at that portion of the cutting tool mount 13 which is furthest away from the center of the cutter 4, and descending toward that portion of the cutting tool mount 13 closest to the center of the cutter 4.

Figure 5:
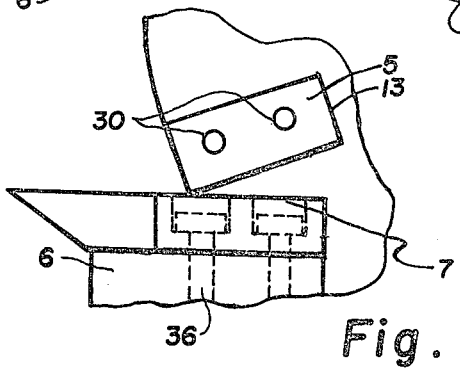
FIG. 5 is a partial expanded broken away view of FIG. 1.
Figure 2:
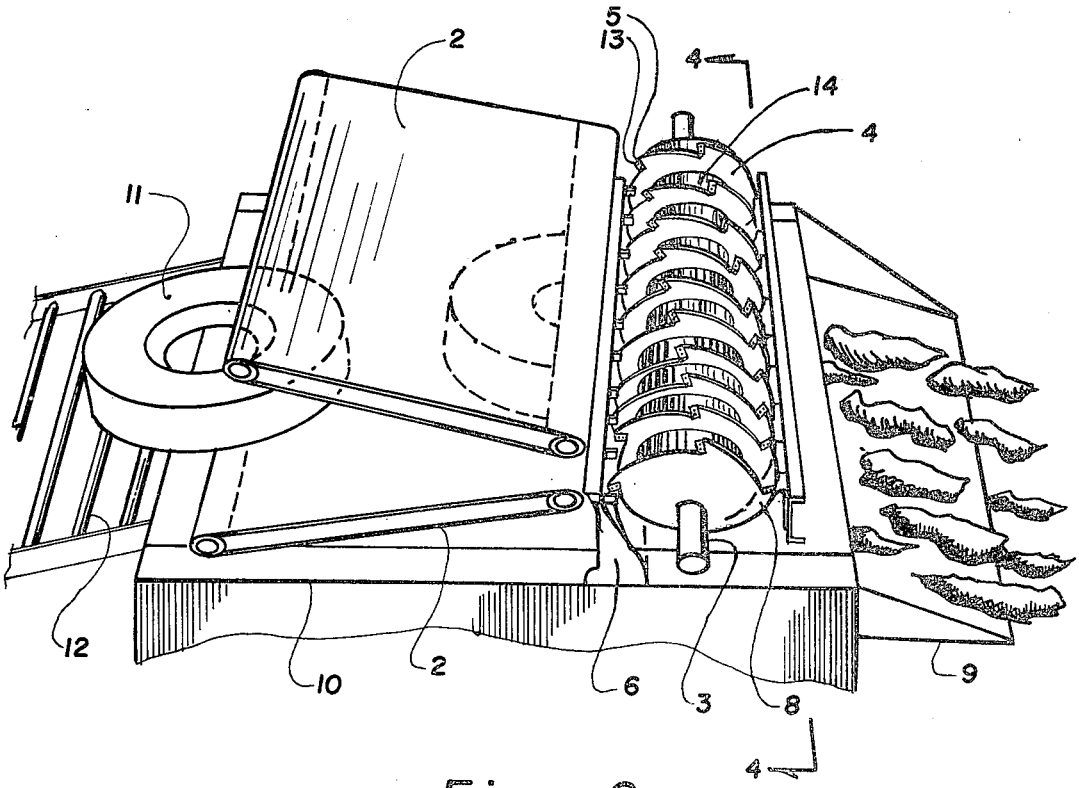
FIG. 2 is a partially cut away perspective elevational view of the present invention.
Figure 3:
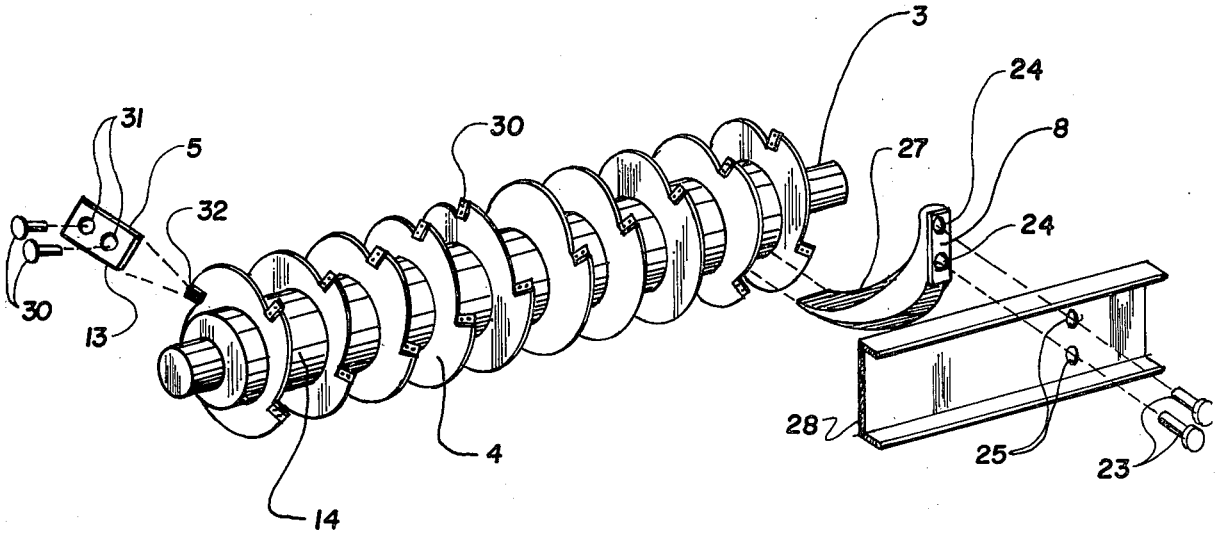
FIG. 3 is partially broken away view of the shaft with rotary disc cutters and cleaner bar.

Referring to FIGS. 3 and 5, cutting tools 5 are attached to cutting tool mount 13 by tool rivets 30 to pass through tool apertures 31 and mount aperture 32.

Figure 4:
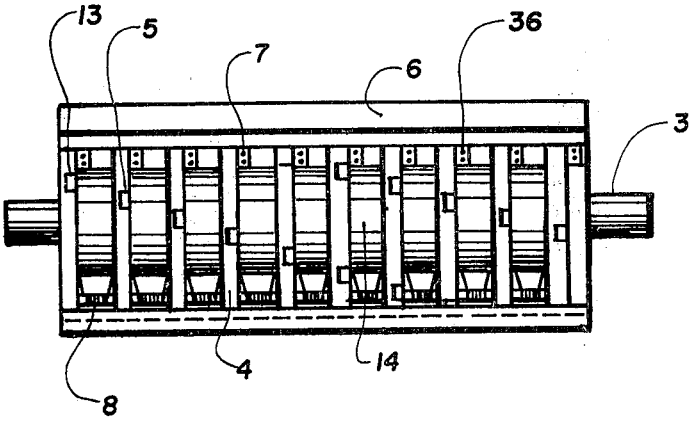
FIG. 4 is a partial sectional view taken along line 4—4 of FIG. 2.

As shown at FIG. 4, stationary anvil 6 is of one piece construction with individual anvil tools 7 secured thereon by use of anvil bolts 36. (see FIG. 5)

The stationary anvil 6 is designed with a space between successive anvil tools 7 so that the cutting tools 5 and rotary disc cutters 4 pass the anvil tools 7 and cut the scrap tire. The pieces of cut scrap tire are then pulled through that space as the disc cutters continue to rotate.

It should be realized that other designs of the shaft 3 and rotary disc cutters would be within teaching of this invention, such as a one piece cast design with outer circumference dimensioned in a manner similar to the design of the rotary disc cutters 4. The present design in practice provides relatively long cutting tool life. In practice it has been found that one set of cutting tools has cut approximately 200,000 assorted scrap tires without needing replacement.

Stationary anvil 6 is attached to housing 10 and placed in close proximity to compression belts 2 and compression rollers 1. Anvil tools 7 of rectangular size are attached to stationary anvil 6 for ease in maintenance of cutting edges. As with the cutting tools 5, the anvil tools preferably have more than one cutting edge and are manufactured out of tool steel, carbide or other alloy. It should be apparent to anyone skilled in the art, that rotary disc cutters 4 and anvil 6 can be designed to work without the use of cutting tools 5 and anvil tools 7. However, the use of cutting tools 5 and anvil tools 7 provide for an easily maintainable and economically useful system.

As the scrap tire 11 is compressed, it is fed into the location where the rotary disc cutters 4 rotate past stationary anvil 6. When the tire reaches the stationary anvil 6 and anvil tool 7, it is cut into pieces by a shearing effect as the compressed scrap tire 11 tends to return to its former uncompressed shape and the cutting tools 5 rotate past the anvil tool 7.

In additional to facilitating the cutting by providing compression of the scrap tire 11, the compression means 15 keeps the tire under control while it is being cut. Compression means 15 holds the tire as the rotary disc cutters 4 rotate against the stationary anvil 6 and prevents overfeeding.

The pieces of cut scrap tire are relatively sticky and tend to accumulate. Referring to FIG. 3, disc support 14 is placed between successive rotary disc cutters 4 to minimize the area available to accumulate cut pieces of scrap tire as well as to strengthen the rotary disc cutters 4. The disc support 14 tends to prevent the rotary disc cutters from flexing while cutting.

Cleaner bars 8 are mounted on housing 10 and placed between successive rotary disc cutters 4. Referring to FIG. 3, the cleaner bars 8 are slanted away from a tapered edge portion in a concave arc. The tapered edge is fit next to the lower portion of the disc support 14. The cleaner bars 8 are placed perpendicular to the shaft 3 in a direction away from the stationary anvil 6.

It is preferred, for ease in manufacture, that the cleaner bars include a shoe 27 attached to bar assembly 28 by bar rivets 23 passing through bar aperture 24 and shoe apertures 25.

As scrap tires are cut in pieces, the pieces tend to stick in the area between the rotary disc cutters 4 and disc support 14 below the shaft 3. The cleaner bars 8 remove said sticking pieces when the tapered edge forces the pieces away from disc support 14 and further rotation of the shaft 3 and rotary disc cutters 4 forces the pieces out of the area between successive rotary disc cutters 4. Having the cleaner bars 8 designed with concave arc slanting from the edge is an important feature of our invention. A cam type of action forces the sticking pieces away from the rotary disc cutters 4 as the sticking pieces subsequently advance along the cleaner bars 8 as the shaft 3 rotates.

Discharge chute 9 is attached to the housing 10 at a location below cleaner bars 8 and away from the stationary anvil 6. The discharge chute 9 is inclined away from the shaft 3 and out of the housing 10. The pieces of cut scrap tire fall after being cut due to the force of gravity, assisted by the rotating shaft 3 and cleaner bars 8, in a downward direction to the discharge chute 9. The pieces then fall along the inclined discharge chute 9 out of housing 10.

As it may readily appear to anyone skilled in the art, various changes may be made in relative locations and arrangements of the several parts without departing from the sphere and scope of this invention. It is not meant to limit the invention except by the following claims:

We claim:

1. An apparatus for cutting scrap tires comprising:

a. a housing;

b. a shaft, mounted on the housing and connected to any conventional power source for rotation purposes;

c. a plurality of rotary disc cutters, of generally circular design, axially spaced along the shaft, dimensioned with at least one cutting tool mount on the outer circumference of each cutter and directed vertically toward the center;

d. cutting tools attached to the rotary disc cutters at the location of the cutting tool mounts, of a generally rectangular design, having at least one cutting edge;

e. compression means for compressing scrap tires and feeding the compressed scrap tire transversely into the rotary disc cutters, associated with the housing;

f. a stationary anvil attached to the housing, placed in close proximity to the compression means and the rotating disc cutters; and g. anvil tools attached to the stationary anvil, of a generally rectangular design having at least one cutting edge, so that the scrap tire is cut into pieces as the compressed scrap tire tends to return to its former uncompressed shape and the cutting tools rotate past the anvil tools.

2. The apparatus of claim 1 wherein the rotary disc cutters are dimensioned with their outer edge recessed in a concave arc starting at that portion of the cutting tool mount which is furthest away from the center and descending toward that portion closest to the center.

3. The apparatus of claim 1 further comprising:

a. a disc support connecting between successive rotary disc cutters for strengthening the rotary disc cutters as well as to minimize volume of area available for accumulation of cut pieces of scrap tire;

b. cleaner bars dimensioned in concave arc slanting away from a tapered edge, with a tapered edge placed between successive rotary disc cutters and the lower portion disc support, to prevent accumulation of cut pieces of scrap tires by a cam type of action that forces the sticking pieces away from the rotary disc cutters as the sticking pieces subsequently advance along the cleaner bars as the shaft rotates; and c. a discharge chute attached to the housing at a location below the cleaner bars and away from the stationary anvil, inclined downwardly away from the shaft and directed out of the housing.

4. The apparatus of claim 3 wherein the stationary anvil is dimensioned with a space between successive anvil tools so that pieces of cut tire are pulled through that space on the way to the discharge chute as the rotary disc cutters rotate.

5. The apparatus of claim 1 wherein the compression means for compressing scrap tires comprises:

a. compression rollers; and b. compression belts.

6. The apparatus of claim 1 wherein the cutting tool mounts and cutting tools situated on adjacent rotary disc cutters are offset along successive rotary disc cutters.

7. The apparatus of claim 1 wherein the stationary anvil is placed below center of the shaft, so that the tire is cut when an edge of the cutting tool at the outer circumference of the rotary disc cutters touches the tire first, then a shear action directed toward the center occurs as the rotary disc cutter continues to rotate.

* * * * *